US009083070B2

(12) United States Patent
Masuda

(10) Patent No.: US 9,083,070 B2
(45) Date of Patent: Jul. 14, 2015

(54) ELECTRONIC COMPONENT

(71) Applicant: Murata Manufacturing Co., Ltd., Nagaokakyo-shi, Kyoto-fu (JP)

(72) Inventor: Hiroshi Masuda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 214 days.

(21) Appl. No.: 13/769,852

(22) Filed: Feb. 19, 2013

(65) Prior Publication Data

US 2013/0214880 A1 Aug. 22, 2013

(30) Foreign Application Priority Data

Feb. 21, 2012 (JP) ..... 2012-034769

(51) Int. Cl.
*H01P 3/08* (2006.01)
*H01P 1/203* (2006.01)

(52) U.S. Cl.
CPC ..... *H01P 1/20309* (2013.01); *H01P 1/20345* (2013.01)

(58) Field of Classification Search
USPC ..... 333/185, 184, 175, 176, 202, 204
See application file for complete search history.

(56) References Cited

U.S. PATENT DOCUMENTS

| | | | | |
|---|---|---|---|---|
| 6,424,235 | B1 | 7/2002 | Kato | |
| 7,432,786 | B2 * | 10/2008 | Tomaki et al. | 333/204 |
| 2002/0048872 | A1 * | 4/2002 | Yamaguchi | 438/200 |
| 2007/0241839 | A1 * | 10/2007 | Taniguchi | 333/185 |
| 2009/0121807 | A1 * | 5/2009 | Tomaki et al. | 333/185 |
| 2010/0171568 | A1 * | 7/2010 | Taniguchi | 333/176 |

FOREIGN PATENT DOCUMENTS

| | | | |
|---|---|---|---|
| JP | 2000-201001 A | | 7/2000 |
| JP | 2000-323902 A | | 11/2000 |
| JP | 2005-012258 A | | 1/2005 |
| JP | 2005012258 A | * | 1/2005 |
| JP | 2006-067222 A | | 3/2006 |
| JP | 2009-012412 A | | 1/2009 |

OTHER PUBLICATIONS

Official Communication issued in corresponding Japanese Patent Application No. 2012-034769, mailed on Jan. 7, 2014.

* cited by examiner

*Primary Examiner* — Lincoln Donovan
*Assistant Examiner* — Thomas Skibinski
(74) *Attorney, Agent, or Firm* — Keating & Bennett, LLP

(57) ABSTRACT

An electronic component includes a laminated body including a plurality of insulator layers laminated on each other in a lamination direction. A first strip line resonator is provided within a first region in the laminated body. A second strip line resonator is provided within a second region in the laminated body. A third strip line resonator is provided within the first region in the laminated body, and in a planar view in a lamination direction, the third strip line resonator and the first strip line resonator sandwich therebetween the second strip line resonator. A coupling conductor capacitively couples the first strip line resonator and the third strip line resonator.

20 Claims, 9 Drawing Sheets

ELECTRONIC COMPONENT

BACKGROUND OF THE INVENTION

1. Field of the Invention

The present invention relates to an electronic component, and relates to an electronic component including a resonator.

2. Description of the Related Art

As an electronic component of the related art, for example, a laminated type dielectric filter described in Japanese Unexamined Patent Application Publication No. 2006-67222 has been known. FIG. 9 is the appearance perspective view of a laminated type dielectric filter 500 described in Japanese Unexamined Patent Application Publication No. 2006-67222. In FIG. 9, the lamination direction of the laminated type dielectric filter 500 is defined as a z-axis direction. In a planar view of the laminated type dielectric filter 500 in the z-axis direction, a direction in which a long side extends is defined as an x-axis direction, and a direction in which a short side extends is defined as a y-axis direction.

The laminated type dielectric filter 500 is used as, for example, a band pass filter, and includes a laminated body 502, a plate electrode 504, and strip line resonators F501 to F503. A plurality of insulator layers are laminated, and hence, the laminated body 502 is configured. The strip line resonators F501 to F503 are arranged in the x-axis direction in this order. In addition, in a planar view in the z-axis direction, the plate electrode 504 extends in the x-axis direction so as to overlap with the strip line resonators F501 and F503. Accordingly, the plate electrode 504 capacitively couples the strip line resonator F501 and the strip line resonator F503 to each other. In such a laminated type dielectric filter 500 as described above, by adjusting coupling capacitance between the strip line resonator F501 and the strip line resonator F503, it may be possible to adjust the transmission characteristics of a high-frequency signal in the laminated type dielectric filter 500.

However, in the laminated type dielectric filter 500 described in Japanese Unexamined Patent Application Publication No. 2006-67222, in a planar view in the z-axis direction, the plate electrode 504 overlaps with the strip line resonator F502 in addition to the strip line resonators F501 and F503. Therefore, owing to the plate electrode 504, the strip line resonator F501 and the strip line resonator F502 are capacitively coupled to each other and the strip line resonator F502 and the strip line resonator F503 are capacitively coupled to each other. Accordingly, it may be difficult to adjust the coupling capacitance between the strip line resonators F501 and F503 without changing coupling capacitance between the strip line resonators F501 and F502 and coupling capacitance between the strip line resonators F502 and F503. Accordingly, when the shape of the plate electrode 504 is designed, it may be necessary to consider the coupling capacitance between the strip line resonators F501 and F502 and the coupling capacitance between the strip line resonators F502 and F503. Therefore, the design of the laminated type dielectric filter 500 may become complicated.

SUMMARY OF THE INVENTION

Accordingly, preferred embodiments of the present invention provide an electronic component capable of being easily designed.

According to a preferred embodiment of the present invention, an electronic component includes a laminated body including a plurality of insulator layers laminated on each other in a lamination direction, a first resonator located within a first region in the laminated body, a second resonator located within a second region different from the first region in the laminated body in the lamination direction, a third resonator located within the first region in the laminated body wherein the third resonator and the first resonator sandwich therebetween the second resonator in a planar view in the lamination direction, and a first coupling conductor arranged to capacitively couple the first resonator and the third resonator to each other.

According to preferred embodiments of the present invention, it is possible to easily design an electronic component.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, an electronic component according to preferred embodiments of the present invention will be described.

Figure 1:
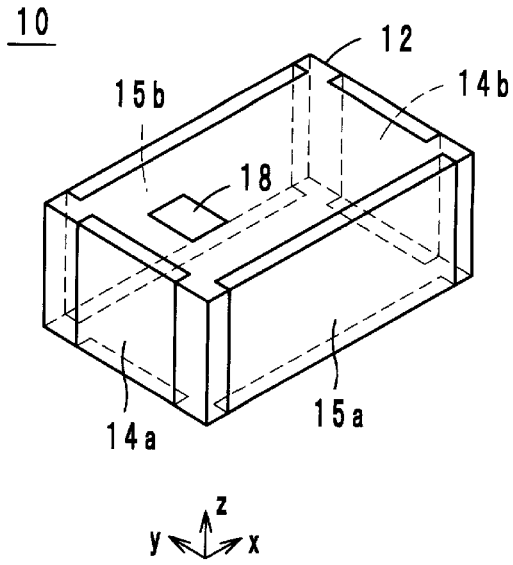
FIG. 1 is an appearance perspective view of an electronic component according to a preferred embodiment of the present invention.
Figure 2:
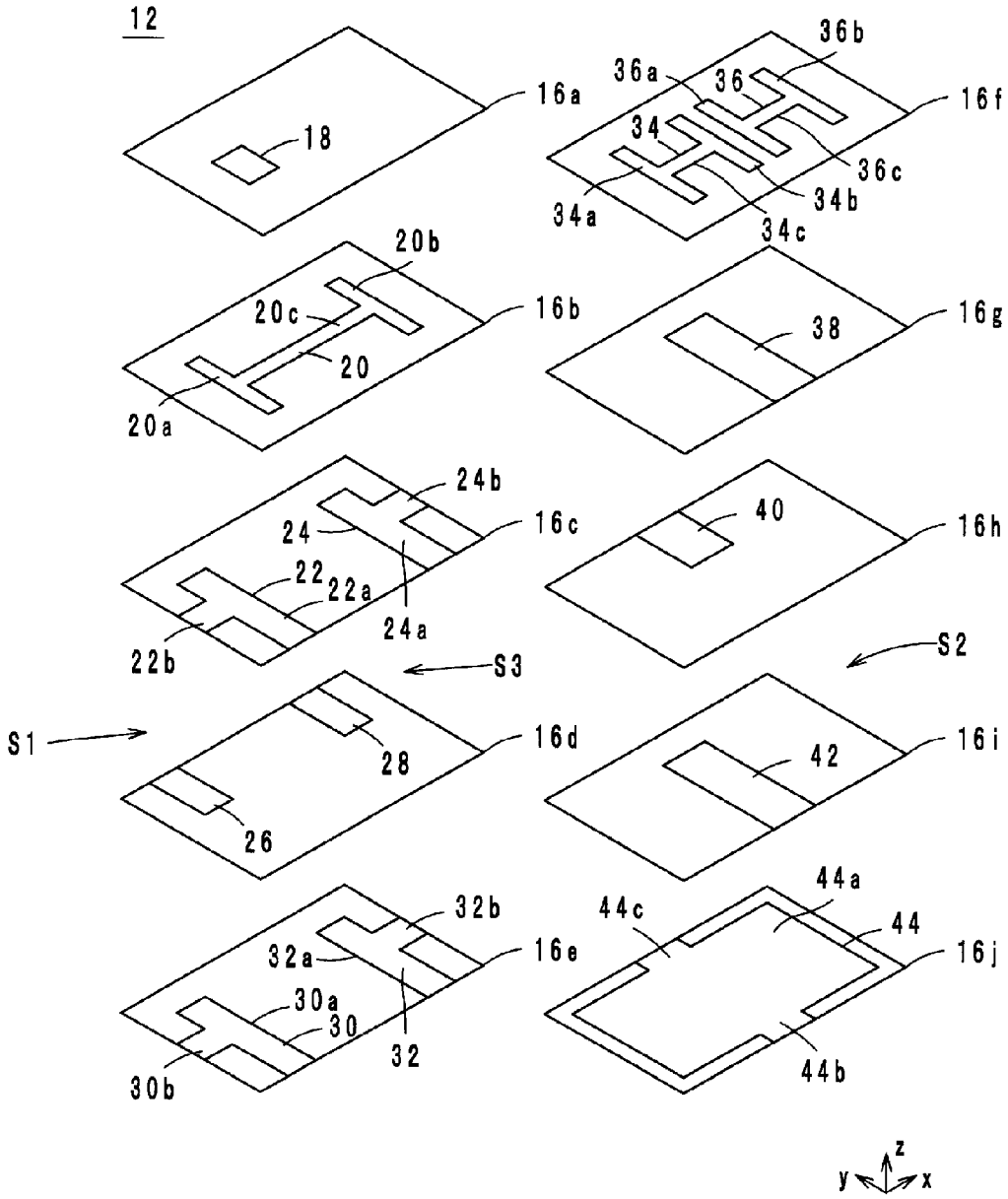
FIG. 2 is an exploded perspective view of the electronic component according to a preferred embodiment of the present invention.
Figure 3:
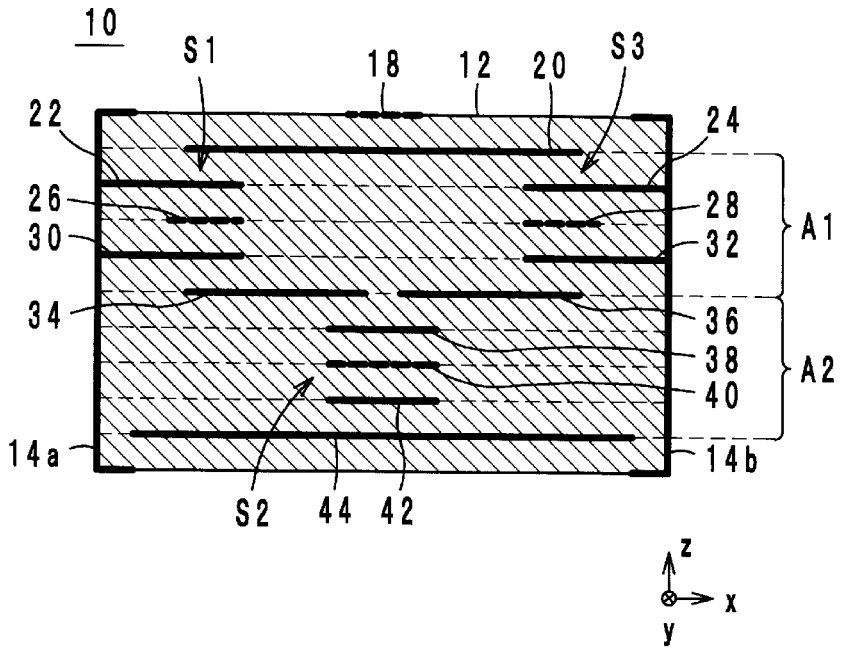
FIG. 3 is a cross-section structure diagram of the electronic component according to a preferred embodiment of the present invention.
Figure 4:
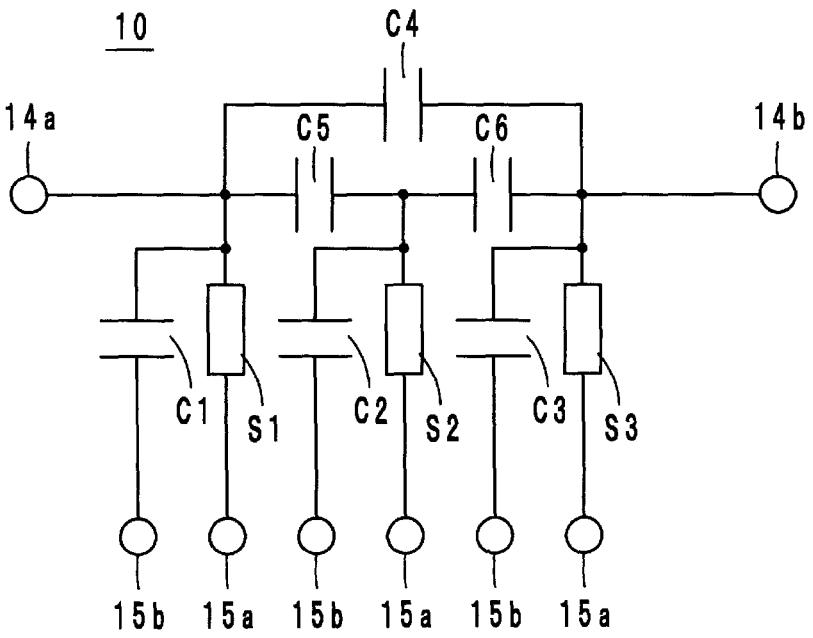
FIG. 4 is an equivalent circuit diagram of the electronic component according to a preferred embodiment of the present invention.

Hereinafter, the structure of an electronic component according to a preferred embodiment of the present invention will be described with reference to drawings. FIG. 1 is the appearance perspective view of an electronic component 10 according to the present preferred embodiment. FIG. 2 is the exploded perspective view of the electronic component 10 according to the present preferred embodiment. FIG. 3 is the cross-section structure diagram of the electronic component 10 according to the present preferred embodiment. FIG. 4 is the equivalent circuit diagram of the electronic component 10 according to the present preferred embodiment.

The electronic component 10 preferably is used as, for example, a band pass filter, and as illustrated in FIG. 1 to FIG. 3. The electronic component 10 preferably includes a laminated body 12, external electrodes 14 (14*a*, 14*b*) and 15 (15*a*, 15*b*), a direction identification mark 18, coupling conductors 20, 34, and 36, resonant conductors 22, 24, 30, 32, 38, and 42, wavelength shortening conductors 26, 28, and 40, and a ground conductor 44.

As illustrated in FIG. 1 to FIG. 3, the laminated body preferably has a rectangular or substantially rectangular parallelepiped shape, a plurality of insulator layers 16 (16*a* to 16*j*) having rectangular or substantially rectangular shapes are laminated so as to be arranged in this order from the positive direction side in the z-axis direction to the negative direction side therein, and hence, the laminated body 12 is configured. Hereinafter, a surface of the insulator layer 16 on a positive direction side in the z-axis direction is referred to as a front surface, and a surface of the insulator layer 16 on a negative direction side in the z-axis direction is referred to as a back surface.

In addition, as illustrated in FIG. 3, in the laminated body 12, a region where the insulator layers 16*b* to 16*e* are provided is defined as a region A1. In addition, in the laminated body 12, a region where the insulator layers 16*f* to 16*i* are provided is defined as a region A2. The region A2 is located at a position different from the region A1 in the lamination direction (in other words, on the negative direction side in the z-axis direction).

As illustrated in FIG. 1 and FIG. 3, the external electrode 14*a* is provided in the end surface of the laminated body 12 on a negative direction side in the x-axis direction, and has a rectangular or substantially rectangular shape extending in the z-axis direction. In addition, the external electrode 14*a* is folded back with respect to the main surfaces of the laminated body 12 on the positive direction side and the negative direction side in the z-axis direction. As illustrated in FIG. 1 and FIG. 3, the external electrode 14*b* is provided in the end surface of the laminated body 12 on a positive direction side in the x-axis direction, and has a rectangular or substantially rectangular shape extending in the z-axis direction. In addition, the external electrode 14*b* is folded back with respect to the main surfaces of the laminated body 12 on the positive direction side and the negative direction side in the z-axis direction. The external electrodes 14*a* and 14*b* face each other across the laminated body 12.

As illustrated in FIG. 1 and FIG. 3, the external electrode 15*a* is provided in the side surface of the laminated body 12 on a negative direction side in the y-axis direction, and preferably has a rectangular or substantially rectangular shape extending in the z-axis direction. In addition, the external electrode 15*a* is folded back with respect to the main surfaces of the laminated body 12 on the positive direction side and the negative direction side in the z-axis direction. As illustrated in FIG. 1 and FIG. 3, the external electrode 15*b* is provided in the side surface of the laminated body 12 on a positive direction side in the y-axis direction, and preferably has a rectangular or substantially rectangular shape extending in the z-axis direction. In addition, the external electrode 15*b* is folded back with respect to the main surfaces of the laminated body 12 on the positive direction side and the negative direction side in the z-axis direction. The external electrodes 15*a* and 15*b* face each other across the laminated body 12.

The resonant conductor 22 is provided in the front surface of the insulator layer 16*c*, and includes a resonant portion 22*a* and an extraction portion 22*b*. The resonant portion 22*a* is a linear conductor extending from the long side of the insulator layer 16*c* on the negative direction side in the y-axis direction to the positive direction side in the y-axis direction. Accordingly, the end portion of the resonant portion 22*a* on the negative direction side in the y-axis direction is connected to the external electrode 15*a*.

The extraction portion 22*b* is connected to the resonant portion 22*a*, and extracted to the short side of the insulator layer 16*c* on the negative direction side in the x-axis direction. Accordingly, the end portion of the extraction portion 22*b* on the negative direction side in the x-axis direction is connected to the external electrode 14*a*.

The resonant conductor 24 is provided in the front surface of the insulator layer 16*c*, and includes a resonant portion 24*a* and an extraction portion 24*b*. The resonant conductor 24 is provided on the positive direction side in the x-axis direction, compared with the resonant conductor 22. The resonant portion 24*a* is a linear conductor extending from the long side of the insulator layer 16*c* on the negative direction side in the y-axis direction to the positive direction side in the y-axis direction. Accordingly, the end portion of the resonant portion 24*a* on the negative direction side in the y-axis direction is connected to the external electrode 15*a*.

The extraction portion 24*b* is connected to the resonant portion 24*a*, and extracted to the short side of the insulator layer 16*c* on the positive direction side in the x-axis direction. Accordingly, the end portion of the extraction portion 24*b* on the positive direction side in the x-axis direction is connected to the external electrode 14*b*.

The resonant conductor 30 is provided in the front surface of the insulator layer 16*e*, and includes a resonant portion 30*a* and an extraction portion 30*b*. Since the structure of the resonant conductor 30 preferably is the same or substantially the same as the structure of the resonant conductor 22, the description thereof will be omitted. In addition, in a planar view in the z-axis direction, the resonant conductor 30 overlaps with the resonant conductor 22 in a state of matching the resonant conductor 22.

The resonant conductor 32 is provided in the front surface of the insulator layer 16*e*, and includes a resonant portion 32*a* and an extraction portion 32*b*. Since the structure of the resonant conductor 32 preferably is the same or substantially the same as the structure of the resonant conductor 24, the description thereof will be omitted. In addition, in a planar view in the z-axis direction, the resonant conductor 32 overlaps with the resonant conductor 24 in a state of matching the resonant conductor 24.

The resonant conductors 22 and 30 configured as described above define a strip line resonator S1 in FIG. 4. In addition, the resonant conductors 24 and 32 define a strip line resonator S3 in FIG. 4. The strip line resonators S1 and S3 preferably are $\lambda/4$ resonators, for example. In addition, as illustrated in FIG. 3, the strip line resonators S1 and S3 are provided within the region A1 in the laminated body 12.

The wavelength shortening conductor 26 is provided in the front surface of the insulator layer 16*d*, and is a linear conductor extending from the long side of the insulator layer 16*d* on the positive direction side in the y-axis direction to the negative direction side in the y-axis direction. Accordingly, the end portion of the wavelength shortening conductor 26 on the positive direction side in the y-axis direction is connected to the external electrode 15*b*. In addition, the end portion of the wavelength shortening conductor 26 on the negative direction side in the y-axis direction faces the end portions of the resonant portions 22*a* and 30*a* in the resonant conductors 22 and 30 on the positive direction side in the y-axis direction through the insulator layers 16*c* and 16*d*. Accordingly, between the wavelength shortening conductor 26 and the resonant conductors 22 and 30, a capacitor C1 illustrated in FIG. 4 is provided. The strip line resonator S1 preferably includes a linear conductor, and an inductance component. Accordingly, the capacitor C1 and the strip line resonator S1 define a parallel resonance circuit. By adequately setting the value of the capacitor C1 in the parallel resonance circuit, an apparent wavelength within a dielectric at the resonance frequency of the parallel resonance circuit becomes shortened. Therefore, it may be possible to shorten the length of the strip line resonator S1.

The wavelength shortening conductor 28 is provided in the front surface of the insulator layer 16*d*, and is a linear conductor extending from the long side of the insulator layer 16*d* on the positive direction side in the y-axis direction to the negative direction side in the y-axis direction. The wavelength shortening conductor 28 is provided on the positive direction side in the x-axis direction, compared with the wavelength shortening conductor 26. The end portion of the wavelength shortening conductor 28 on the positive direction side in the y-axis direction is connected to the external electrode 15*b*. In addition, the end portion of the wavelength shortening conductor 28 on the negative direction side in the y-axis direction faces the end portions of the resonant portions 24*a* and 32*a* in the resonant conductors 24 and 32 on the positive direction side in the y-axis direction through the insulator layers 16*c* and 16*d*. Accordingly, between the wavelength shortening conductor 28 and the resonant conductors 24 and 32, a capacitor C3 illustrated in FIG. 4 is provided. Since being configured using a linear conductor, the strip line resonator S3 includes an inductance component. Accordingly, the capacitor C3 and the strip line resonator S3 define a parallel resonance circuit. By adequately setting the value of the capacitor C3 in the parallel resonance circuit, an apparent wavelength at the resonance frequency of the parallel resonance circuit becomes shortened. Therefore, it may be possible to shorten the length of the strip line resonator S3.

The resonant conductor 38 is provided in the front surface of the insulator layer 16*g*, and is a linear conductor extending from the long side of the insulator layer 16*g* on the negative direction side in the y-axis direction to the positive direction side in the y-axis direction. Accordingly, the end portion of the resonant conductor 38 on the negative direction side in the y-axis direction is connected to the external electrode 15*a*. In addition, in a planar view in the z-axis direction, the resonant conductor 38 is provided between the resonant conductors 22 and 30 and the resonant conductors 24 and 32 in the x-axis direction.

The resonant conductor 42 is provided in the front surface of the insulator layer 16*i*, and is a linear conductor extending from the long side of the insulator layer 16*i* on the negative direction side in the y-axis direction to the positive direction side in the y-axis direction. Since the structure of the resonant conductor 42 is preferably the same or substantially the same as the structure of the resonant conductor 38, the description thereof will be omitted. In addition, in a planar view in the z-axis direction, the resonant conductor 42 overlaps with the resonant conductor 38 in a state of matching the resonant conductor 38.

The resonant conductors 38 and 42 configured as described above configure a strip line resonator S2 in FIG. 4. The strip line resonator S2 preferably is a $\lambda/4$ resonator, for example. In addition, as illustrated in FIG. 3, the strip line resonator S2 is provided within the region A2 in the laminated body 12. In addition, in a planar view in the z-axis direction, the strip line resonator S2 is sandwiched by the strip line resonators S1 and S3 from both sides in the x-axis direction.

The wavelength shortening conductor 40 preferably is provided in the front surface of the insulator layer 16*h*, and is a linear conductor extending from the long side of the insulator layer 16*h* on the positive direction side in the y-axis direction to the negative direction side in the y-axis direction. Accordingly, the end portion of the wavelength shortening conductor 40 on the positive direction side in the y-axis direction is connected to the external electrode 15*b*. In addition, the end portion of the wavelength shortening conductor 40 on the negative direction side in the y-axis direction faces the end portions of the resonant conductors 38 and 42 on the positive direction side in the y-axis direction through the insulator layers 16*g* and 16*h*. Accordingly, between the wavelength shortening conductor 40 and the resonant conductors 38 and 42, a capacitor C2 illustrated in FIG. 4 is provided. Since being configured using a linear conductor, the strip line resonator S2 includes an inductance component. Accordingly, the capacitor C2 and the strip line resonator S2 define a parallel resonance circuit. By adequately setting the value of the capacitor C2 in the parallel resonance circuit, an apparent wave length at the resonance frequency of the parallel resonance circuit becomes shortened. Therefore, it may be possible to shorten the length of the strip line resonator.

The coupling conductor 20 capacitively couples the strip line resonator S1 and the strip line resonator S3 to each other. The coupling conductor 20 is provided in the front surface of the insulator layer 16*b*, and provided on the opposite side of the strip line resonator S2 with respect to the strip line resonators S1 and S3 (in other words, on the positive direction side in the z-axis direction, compared with the strip line resonators S1 and S3). The coupling conductor 20 preferably is H-shaped or substantially H-shaped, and includes coupling portions 20*a* and 20*b* and a connection portion 20*c*.

The coupling portion 20*a* is a linear conductor extending in the y-axis direction, and faces the resonant portion 22*a* through the insulator layer 16*b*. Accordingly, between the coupling portion 20*a* and the resonant portion 22*a*, an electrostatic capacity is provided. The coupling portion 20*b* is a linear conductor extending in the y-axis direction, and faces the resonant portion 24*a* through the insulator layer 16*b*. Accordingly, between the coupling portion 20*b* and the resonant portion 24*a*, an electrostatic capacity is provided. The coupling portion 20*b* is provided on the positive direction side in the x-axis direction, compared with the coupling portion 20*a*. The connection portion 20*c* extends in the x-axis direction, and connects the center of the coupling portion 20*a* in the y-axis direction and the center of the coupling portion 20*b* in the y-axis direction to each other. Accordingly, between the resonant conductors 22 and 24, two electrostatic capacities are connected in series.

The coupling conductor 20 configured as described above defines a capacitor C4 illustrated in FIG. 4, together with the resonant conductors 22 and 24.

The coupling conductor 34 capacitively couples the strip line resonator S1 and the strip line resonator S2 to each other. The coupling conductor 34 is provided in the front surface of the insulator layer 16*f*, and provided between the strip line resonators S1 and S3 and the strip line resonator S2 in the z-axis direction. The coupling conductor 34 preferably is H-shaped or substantially H-shaped, and includes coupling portions 34*a* and 34*b* and a connection portion 34*c*.

The coupling portion 34*a* is a linear conductor extending in the y-axis direction, and faces the resonant portion 30*a* through the insulator layer 16*e*. Accordingly, between the coupling portion 34*a* and the resonant portion 30*a*, an electrostatic capacity is provided. The coupling portion 34*b* is a linear conductor extending in the y-axis direction, and faces the resonant conductor 38 through the insulator layer 16*f*. Accordingly, between the coupling portion 34*b* and the resonant conductor 38, an electrostatic capacity is provided. The coupling portion 34*b* is provided on the positive direction side in the x-axis direction, compared with the coupling portion 34*a*. The connection portion 34*c* extends in the x-axis direction, and connects the center of the coupling portion 34*a* in the y-axis direction and the center of the coupling portion 34*b* in the y-axis direction to each other. Accordingly, between the resonant conductors 30 and 38, two electrostatic capacities are connected in series.

The coupling conductor 34 configured as described above defines a capacitor C5 illustrated in FIG. 4, together with the resonant conductors 30 and 38.

The coupling conductor 36 capacitively couples the strip line resonator S2 and the strip line resonator S3 to each other. The coupling conductor 36 is provided in the front surface of the insulator layer 16*f*, and provided between the strip line resonators S1 and S3 and the strip line resonator S2 in the z-axis direction. The coupling conductor 36 is provided on the positive direction side in the x-axis direction, compared with the coupling conductor 34. The coupling conductor 36 preferably is H-shaped or substantially H-shaped, and includes coupling portions 36*a* and 36*b* and a connection portion 36*c*.

The coupling portion 36*a* is a linear conductor extending in the y-axis direction, and faces the resonant conductor 38 through the insulator layer 16*f*. Accordingly, between the coupling portion 36*a* and the resonant conductor 38, an electrostatic capacity is provided. The coupling portion 36*b* is a linear conductor extending in the y-axis direction, and faces the resonant portion 32*a* through the insulator layer 16*e*. Accordingly, between the coupling portion 36*b* and the resonant portion 32*a*, an electrostatic capacity is provided. The coupling portion 36*b* is provided on the positive direction side in the x-axis direction, compared with the coupling portion 36*a*. The connection portion 36*c* extends in the x-axis direction, and connects the center of the coupling portion 36*a* in the y-axis direction and the center of the coupling portion 36*b* in the y-axis direction to each other. Accordingly, between the resonant conductors 32 and 38, two electrostatic capacities are connected in series.

The coupling conductor 36 configured as described above defines a capacitor C6 illustrated in FIG. 4, together with the resonant conductors 32 and 38.

The ground conductor 44 is provided in the front surface of the insulator layer 16*j*, and includes a main body portion 44*a* and extraction portions 44*b* and 44*c*. The main body portion 44*a* preferably is a rectangular or substantially rectangular shaped conductor covering approximately the entire surface of the insulator layer 16*j*. In this regard, however, the main body portion 44*a* is not in contact with the outer edge of the insulator layer 16*j*. The extraction portion 44*b* is connected to the main body portion 44*a*, and extracted to the long side of the insulator layer 16*j* on the negative direction side in the y-axis direction. Accordingly, the extraction portion 44*b* is connected to the external electrode 15*a*. The extraction portion 44*c* is connected to the main body portion 44*a*, and extracted to the long side of the insulator layer 16*j* on the positive direction side in the y-axis direction. Accordingly, the extraction portion 44*c* is connected to the external electrode 15*b*.

The direction identification mark 18 is provided in the front surface of the insulator layer 16*a*. The direction identification mark 18 is used when the direction of the electronic component 10 is identified.

The electronic component 10 configured as described above includes a circuit configuration illustrated in FIG. 4. In more detail, between the external electrodes 14*a* and 14*b*, the capacitors C5 and C6 are connected in series. The capacitor C4 is connected in parallel to the capacitors C5 and C6.

In addition, the strip line resonator S1 is connected between the external electrode 14*a* and the external electrode 15*a*. The capacitor C1 is connected between the external electrode 14*a* and the external electrode 15*b*.

In addition, the strip line resonator S2 is connected between a point between the capacitors C5 and C6 and the external electrode 15*a*. The capacitor C2 is connected between the point between the capacitors C5 and C6 and the external electrode 15*b*.

In addition, the strip line resonator S3 is connected between the external electrode 14*b* and the external electrode 15*a*. The capacitor C3 is connected between the external electrode 14*b* and the external electrode 15*b*.

When the electronic component 10 configured as described above is used as a band pass filter, for example, the external electrode 14*a* is used as an input terminal, the external electrode 14*b* is used as an output terminal, and the external electrodes 15*a* and 15*b* are used as ground terminals.

The strip line resonator S1 and the strip line resonator S2 are magnetically coupled to each other, and capacitively coupled to each other through the capacitor C5. In addition, the strip line resonator S2 and the strip line resonator S3 are magnetically coupled to each other, and capacitively coupled to each other through the capacitor C6. Accordingly, when a high-frequency signal has been input from the external terminal 14*a*, a signal of a resonance frequency determined on the basis of the strip line resonators S1 to S3 and the capacitors C1 to C3 is output to the external terminal 14*b* as a result of the effects of the magnetic field coupling and the capacitive coupling between the strip line resonators S1 to S3 described above, and the electronic component 10 functions as a band pass filter. In addition, the capacitor C4 is provided so as to improve the attenuation characteristic of a band other than the pass band of the electronic component 10.

Hereinafter, a non-limiting example of a manufacturing method for the electronic component 10 will be described with reference to FIG. 1 and FIG. 2.

First, ceramic green sheets to be the insulator layers 16 are prepared.

Next, using a method such as a screen printing method or a photolithographic method, a conductive paste whose main component is Ag, Pd, Cu, Au, or alloy thereof is applied to the front surfaces of ceramic green sheets to be the insulator layers 16*a* to 16*j*, and hence, the direction identification mark 18, the coupling conductors 20, 34, and 36, the resonant conductors 22, 24, 30, 32, 38, and 42, the wavelength shortening conductors 26, 28, and 40, and the ground conductor 44 are formed.

Next, the ceramic green sheets to define the insulator layer 16*a* to 16*j* are laminated and subjected to pressure bonding so as to be arranged in this order from the positive direction side in the z-axis direction to the negative direction side therein. As a result of the above-mentioned process, a mother laminated body is formed. Final pressure bonding due to isostatic press or the like is performed on this mother laminated body.

Next, using a cutting blade, the mother laminated body is cut into the laminated body 12 having a predetermined dimension. A binder removal process and firing are performed on this unfired laminated body 12.

As a result of the above-mentioned process, the fired laminated body 12 is obtained. The laminated body 12 is subjected to barrel processing and chamfered.

Next, a conductive paste whose main component is Ag, Pd, Cu, Au, or alloy thereof is applied to the side surfaces and the end surfaces of the laminated body 12, and hence, underlying electrodes to be the external electrodes 14*a*, 14*b*, 15*a*, and 15*b* are formed.

Finally, Ni plating or Sn plating is performed on the surfaces of the underlying electrodes to be the external electrodes 14*a*, 14*b*, 15*a*, and 15*b*. Through the above-mentioned process, the electronic component 10 illustrated in FIG. 1 is completed.

As for the electronic component 10 configured as described above, it may be possible to easily design the electronic component 10. In more detail, in the laminated type dielectric filter 500 described in Japanese Unexamined Patent Application Publication No. 2006-67222, in a planar view in the z-axis direction, the plate electrode 504 overlaps with the strip line resonator F502 in addition to the strip line resonators F501 and F503. Therefore, due to the plate electrode 504, the strip line resonator F501 and the strip line resonator F502 are capacitively coupled to each other and the strip line resonator F502 and the strip line resonator F503 are capacitively coupled to each other. Accordingly, it may be difficult to adjust the coupling capacitance between the strip line resonators F501 and F503 without changing the coupling capacitance between the strip line resonators F501 and F502 and coupling the capacitance between the strip line resonators F502 and F503. Accordingly, when the shape of the plate electrode 504 is designed, it is necessary to consider the coupling capacitance between the strip line resonators F501 and F502 and the coupling capacitance between the strip line resonators F502 and F503. Therefore, the design of the laminated type dielectric filter 500 may become complicated.

On the other hand, in the electronic component 10 according to a preferred embodiment of the present invention, the strip line resonators S1 and S3 sandwiching therebetween the strip line resonator S2 in the y-axis direction are provided in the region A1, and the strip line resonator S2 is provided in the region A2. The coupling conductor 20 capacitively couples the strip line resonator S1 and the strip line resonator S2 to each other. The region A1 and the region A2 do not overlap with each other in the z-axis direction. Therefore, the strip line resonators S1 and S3 and the strip line resonator S2 are spaced away from each other. Accordingly, due to the coupling conductor 20, it is possible to capacitively couple the strip line resonator S1 and the strip line resonator S3 to each other with hardly capacitively coupling the strip line resonator S1 and the strip line resonator S2 to each other and hardly capacitively coupling the strip line resonator S2 and the strip line resonator S3 to each other. Accordingly, when the coupling capacitance of the capacitor C4 between the strip line resonator S1 and the strip line resonator S3 is designed, it is rarely necessary to consider coupling capacitance between the strip line resonators S1 and S2 and coupling capacitance between the strip line resonators S2 and S3. As a result, it may become possible to easily design the electronic component 10.

Furthermore, in the electronic component 10, the strip line resonator S2 is provided on the negative direction side in the z-axis direction, compared with the strip line resonators S1 and S3, and the coupling conductor 20 is provided on the positive direction side in the z-axis direction, compared with the strip line resonators S1 and S3. Accordingly, it is possible to effectively prevent the strip line resonators S1 and S3 and the strip line resonator S2 from being capacitively coupled to each other through the coupling conductor 20.

Figure 5:
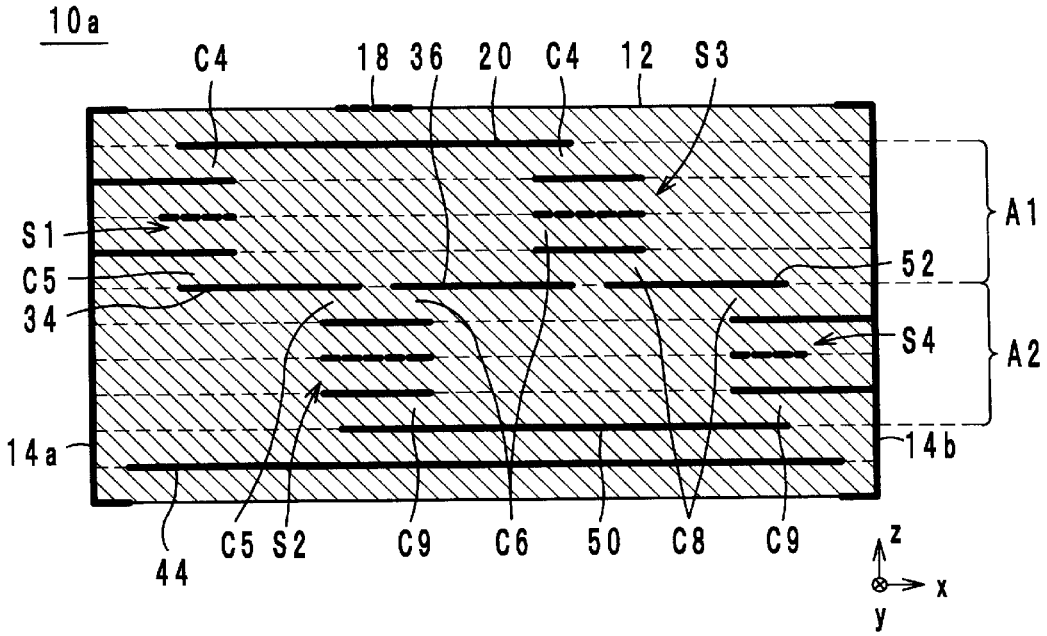
FIG. 5 is a cross-section structure diagram of an electronic component according to a first example of a modification of a preferred embodiment of the present invention.
Figure 6:
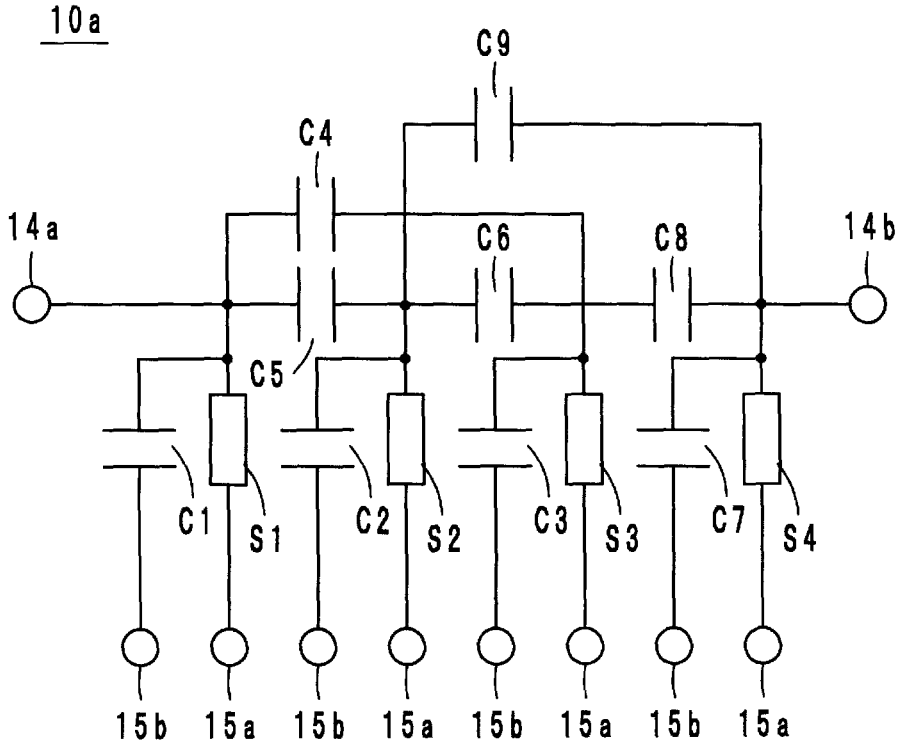
FIG. 6 is an equivalent circuit diagram of the electronic component according to the first example of a modification of a preferred embodiment of the present invention.

Hereinafter, an electronic component according to a first example of a modification of a preferred embodiment of the present invention will be described with reference to drawings. FIG. 5 is the cross-section structure diagram of an electronic component 10*a* according to the first example of a modification of a preferred embodiment of the present invention. FIG. 6 is the equivalent circuit diagram of the electronic component 10*a* according to the first example of a modification of a preferred embodiment of the present invention.

As illustrated in FIG. 5 and FIG. 6, with respect to the electronic component 10, the electronic component 10*a* further includes a strip line resonator S4 and coupling conductors 50 and 52. As illustrated in FIG. 5, the strip line resonator S4 is provided within the region A2 in the laminated body 12, and in a planar view in the z-axis direction, the strip line resonator S4 and the strip line resonator S2 sandwich therebetween the strip line resonator S3 in the x-axis direction.

In addition, the coupling conductor 50 capacitively couples the strip line resonator S2 and the strip line resonator S4 to each other. In more detail, as illustrated in FIG. 5, the coupling conductor 50 is provided on the negative direction side in the z-axis direction, compared with the strip line resonators S2 and S4, and overlaps with the strip line resonators S2 and S4 in a planar view in the z-axis direction. Accordingly, a capacitor C9 is provided between the strip line resonators S2 and S4.

In addition, the coupling conductor 52 capacitively couples the strip line resonator S3 and the strip line resonator S4 to each other. In more detail, the coupling conductor 52 is provided between the strip line resonator S3 and the strip line resonator S4 in the z-axis direction, and overlaps with the strip line resonators S3 and S4 in a planar view in the z-axis direction. Accordingly, a capacitor C8 is provided between the strip line resonators S3 and S4.

In the electronic component 10*a* configured as described above, through the coupling conductor 50, the strip line resonator S2 and the strip line resonator S4 are capacitively coupled to each other, and the strip line resonators S2 and S4 and the strip line resonator S3 are hardly capacitively coupled to each other. Therefore, when the coupling capacitance of the capacitor C9 between the strip line resonator S2 and the strip line resonator S4 is designed, it is rarely necessary to consider coupling capacitance between the strip line resonators S2 and S3 and coupling capacitance between the strip line resonators S3 and S4. As a result, it is possible to easily design the electronic component 10*a*.

Figure 7:
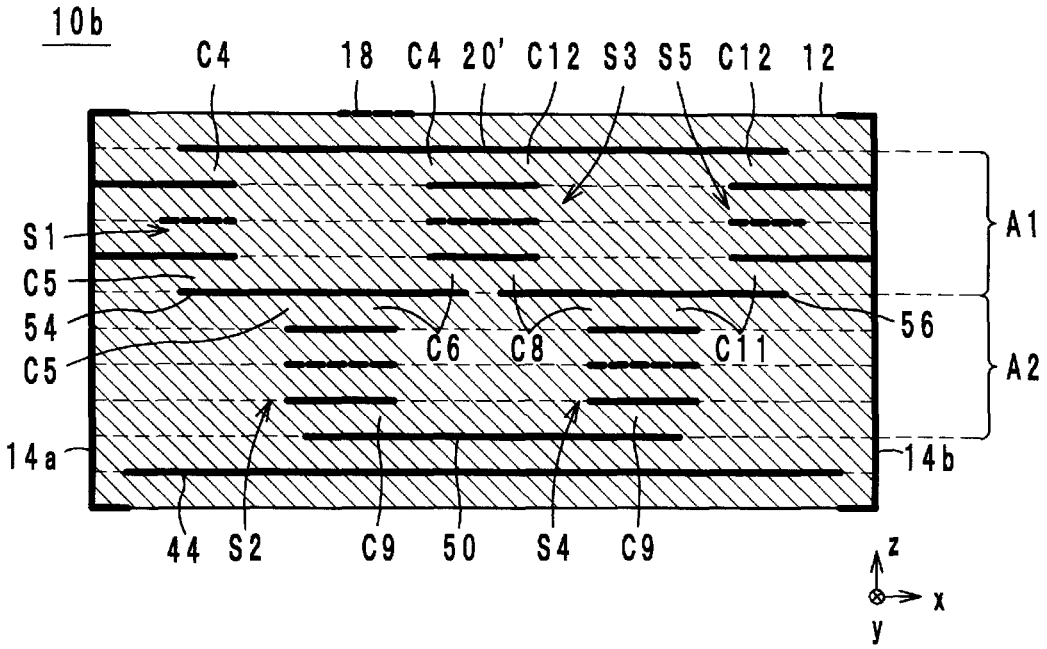
FIG. 7 is a cross-section structure diagram of an electronic component according to a second example of a modification of a preferred embodiment of the present invention.
Figure 8:
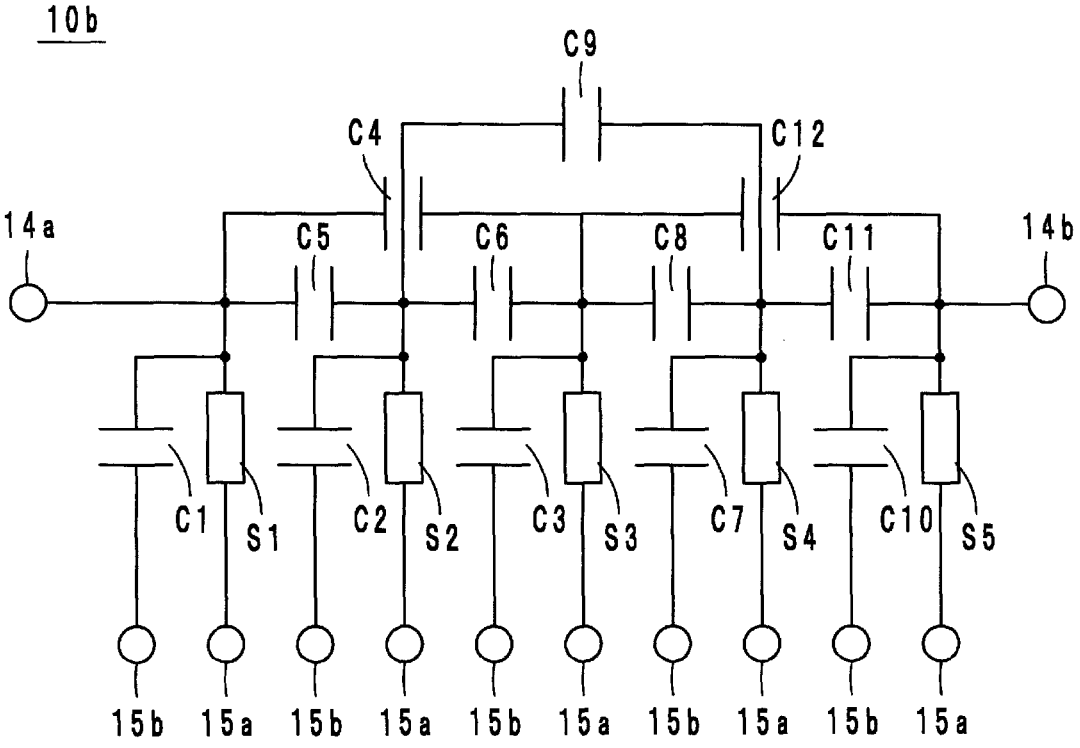
FIG. 8 is an equivalent circuit diagram of the electronic component according to the second example of a modification of a preferred embodiment of the present invention.
Figure 9:
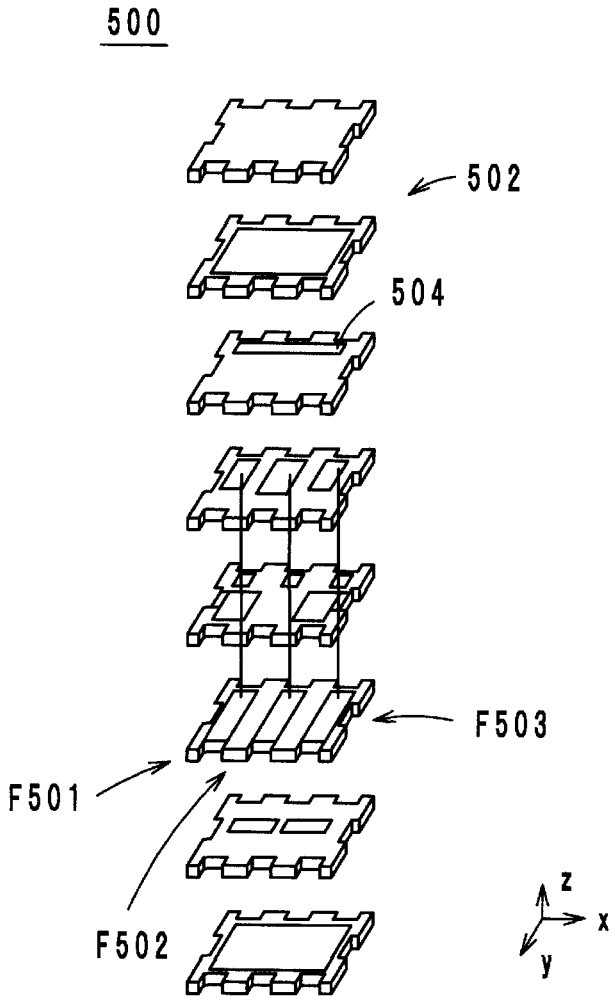
FIG. 9 PRIOR ART
FIG. 9 is an appearance perspective view of a laminated type dielectric filter described in Japanese Unexamined Patent Application Publication No. 2006-67222.

Hereinafter, an electronic component according to a second example of a modification of a preferred embodiment of the present invention will be described with reference to drawings. FIG. 7 is the cross-section structure diagram of an electronic component 10*b* according to the second example of a modification of a preferred embodiment of the present invention. FIG. 8 is the equivalent circuit diagram of the electronic component 10*b* according to the second example of a modification of a preferred embodiment of the present invention.

As illustrated in FIG. 7 and FIG. 8, with respect to the electronic component 10*a*, the electronic component 10*b* further includes a strip line resonator S5 and coupling conductors 54 and 56. In addition, the electronic component 10*b* includes a coupling conductor 20' in place of the coupling conductor 20.

As illustrated in FIG. 7, the strip line resonator S5 is provided within the region A1 in the laminated body 12, and in a planar view in the z-axis direction, the strip line resonator S5 and the strip line resonator S3 sandwich therebetween the strip line resonator S4.

In addition, the coupling conductor 54 capacitively couples the strip line resonator S1 and the strip line resonator S2 to each other. Furthermore, the coupling conductor 54 capacitively couples the strip line resonator S2 and the strip line resonator S3 to each other. The coupling conductor 54 capacitively couples the strip line resonator S2 and the strip line resonator S3 to each other. In more detail, as illustrated in FIG. 7, the coupling conductor 54 is provided between the strip line resonators S1 and S3 and the strip line resonator S2 in the z-axis direction, and overlaps with the strip line resonators S1 to S3 in a planar view in the z-axis direction. Accordingly, the capacitor C5 is provided between the strip line resonators S1 and S2. The capacitor C6 is provided between the strip line resonators S2 and S3.

In addition, the coupling conductor 56 capacitively couples the strip line resonator S3 and the strip line resonator S4 to each other. Furthermore, the coupling conductor 56 capacitively couples the strip line resonator S4 and the strip line resonator S5 to each other. The coupling conductor 56 capacitively couples the strip line resonator S4 and the strip line resonator S5 to each other. In more detail, as illustrated in FIG. 7, the coupling conductor 56 is provided between the strip line resonators S3 and S5 and the strip line resonator S4 in the z-axis direction, and overlaps with the strip line resonators S3 to S5 in a planar view in the z-axis direction. Accordingly, the capacitor C8 is provided between the strip line resonators S3 and S4. A capacitor C11 is provided between the strip line resonators S4 and S5.

In addition, the coupling conductor 20' capacitively couples the strip line resonator S1 and the strip line resonator S3 to each other. Furthermore, the coupling conductor 20' capacitively couples the strip line resonator S3 and the strip line resonator S5 to each other. In more detail, as illustrated in FIG. 7, the coupling conductor 20' is provided on the positive direction side in the z-axis direction, compared with the strip line resonators S1, S3, and S5, and overlaps with the strip line resonators S1, S3, and S5 in a planar view in the z-axis direction. Accordingly, the capacitor C4 is provided between the strip line resonators S1 and S3. A capacitor C12 is provided between the strip line resonators S3 and S5.

In the electronic component 10*b* configured as described above, through the coupling conductor 20', the strip line resonator S1 and the strip line resonator S3 are capacitively coupled to each other, and the strip line resonators S1 and S3 and the strip line resonator S2 are hardly capacitively coupled to each other. Accordingly, when the coupling capacitance of the capacitor C4 between the strip line resonator S1 and the strip line resonator S3 is designed, it is rarely necessary to consider coupling capacitance between the strip line resonators S1 and S2 and coupling capacitance between the strip line resonators S2 and S3.

Furthermore, through the coupling conductor 20', the strip line resonator S3 and the strip line resonator S5 are capacitively coupled to each other, and the strip line resonators S3 and S5 and the strip line resonator S4 are hardly capacitively coupled to each other. Therefore, when the coupling capacitance of the capacitor C12 between the strip line resonator S3 and the strip line resonator S5 is designed, it is rarely necessary to consider coupling capacitance between the strip line resonators S3 and S4 and coupling capacitance between the strip line resonators S4 and S5. As a result, it is possible to easily design the electronic component 10*b*.

As described above, preferred embodiments of the present invention are useful for an electronic component, and, in particular, superior in terms of being capable of easily designing an electronic component.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An electronic component comprising:

a laminated body including a plurality of insulator layers being laminated on each other in a lamination direction;

a first resonator provided within a first region in the laminated body;

a second resonator provided within a second region different from the first region in the laminated body in the lamination direction;

a third resonator provided within the first region in the laminated body such that the third resonator and the first resonator sandwich therebetween the second resonator in a planar view in the lamination direction;

a first coupling conductor arranged to capacitively couple the first resonator and the third resonator to each other;

a second coupling conductor arranged to capacitively couple the first resonator and the second resonator to each other; and a third coupling conductor arranged to capacitively couple the second resonator and the third resonator to each other.

2. The electronic component according to claim 1, wherein, in the lamination direction, the first coupling conductor is provided on a side of the first resonator and the third resonator opposite to a side of the first resonator and the third resonator on which the second resonator is provided.

3. The electronic component according to claim 2, wherein the second coupling conductor is H-shaped or substantially H-shaped.

4. The electronic component according to claim 1, wherein the second coupling conductor and the third coupling conductor are provided between the first and third resonators and the second resonator in the lamination direction.

5. The electronic component according to claim 1, further comprising:

a fourth resonator provided within the second region in the laminated body such that the fourth resonator and the second resonator sandwich therebetween the third resonator; and a fourth coupling conductor arranged to capacitively couple the second resonator and the fourth resonator to each other.

6. The electronic component according to claim 5, wherein the first resonator, the second resonator, the third resonator and the fourth resonator are strip line resonators.

7. The electronic component according to claim 6, wherein the strip line resonators are $\lambda/4$ resonators.

8. The electronic component according to claim 6, wherein the strip line resonators are provided within the first region in the laminated body.

9. The electronic component according to claim 1, wherein the electronic component is a band-pass filter.

10. The electronic component according to claim 1, wherein each of the first resonator, the second resonator, and the third resonator includes a resonant portion, and each of the first resonator and the third resonator includes an extraction portion.

11. The electronic component according to claim 10, wherein the resonant portion includes a linear conductor.

12. The electronic component according to claim 1, further comprising a wavelength-shortening conductor including a linear conductor.

13. The electronic component according to claim 12, further comprising a capacitor provided between the wavelength-shortening conductor and two of the first resonator, the second resonator, the third resonator and a fourth resonator, so as to define a parallel resonance circuit with a strip line resonator.

14. The electronic component according to claim 1, wherein the first coupling conductor is H-shaped or substantially H-shaped.

15. The electronic component according to claim 1, further comprising external electrodes defining an input terminal, an output terminal and ground terminals.

16. The electronic component according to claim 1, further comprising first, second, third and fourth strip line resonators and two additional coupling conductors, wherein the fourth strip line resonator is provided in the second region in the laminated body.

17. The electronic component according to claim 16, wherein the second and fourth strip line resonators sandwich therebetween the third strip line resonator.

18. The electronic component according to claim 16, wherein a first of the two additional coupling conductors capacitively couples the second and fourth strip line resonators to each other, and a second of the two additional coupling conductors capacitively couples the third and fourth strip line resonators to each other.

19. The electronic component according to claim 16, further comprising a fifth strip line resonator and two more additional coupling capacitors.

20. An electronic component comprising:

a laminated body including a plurality of insulator layers being laminated on each other in a lamination direction;

a first resonator provided within a first region in the laminated body;

a second resonator provided within a second region different from the first region in the laminated body in the lamination direction;

a third resonator provided within the first region in the laminated body such that the third resonator and the first resonator sandwich therebetween the second resonator in a planar view in the lamination direction; and a first coupling conductor arranged to capacitively couple the first resonator and the third resonator to each other; wherein the first coupling conductor is H-shaped or substantially H-shaped.

* * * * *